United States Patent [19]

Alonso

[11] Patent Number: 5,023,961

[45] Date of Patent: Jun. 18, 1991

[54] BIDET ACCESSORY

[76] Inventor: Nelson A. Alonso, 1701 SW. 32 Ct., Miami, Fla. 33145

[21] Appl. No.: 279,741

[22] Filed: Dec. 5, 1988

[51] Int. Cl.[5] ..... A61H 35/00

[52] U.S. Cl. ..... 4/448; 4/420.4; 4/443; 248/279; 248/231.7

[58] Field of Search ..... 4/420.1, 420.2, 420.3, 4/420.4, 420.5, 443, 444, 445, 446, 447, 448; 248/285, 286, 298, 279, 231.7

[56] References Cited

U.S. PATENT DOCUMENTS

| | | | |
|---|---|---|---|
| 1,057,658 | 4/1913 | Nichols | 248/287 |
| 2,914,829 | 12/1959 | Willemain | 248/279 |
| 3,513,487 | 5/1970 | Palermo et al. | 4/420.4 |
| 4,135,255 | 1/1979 | Menendez | 4/448 |
| 4,195,369 | 4/1980 | Lesick | 4/448 |
| 4,596,058 | 6/1986 | Nourbakhsh | 4/448 |

*Primary Examiner*—Henry J. Recla
*Assistant Examiner*—Edward C. Donovan
*Attorney, Agent, or Firm*—J. Sanchelima

[57] ABSTRACT

A bidet accessory for mounting to the rear flanged section of two-piece toilet fixtures and removably connected to hot and cold water supplies. An outlet is connected through a flexible conduit to a sprayer that is, when not in use, held in place by the supporting assembly. A mounting assembly is mounted to the supporting assembly and it allows for the installation of the bidet accessory in a multitude of different angles depending on the users' preferences and space constraints.

5 Claims, 3 Drawing Sheets

BIDET ACCESSORY

BACKGROUND OF THE INVENTION

1. Field of the Invention

The present invention relates to accessories for toilets, and more particularly, to a removable bidet accessory.

2. Description of the Related Art

Bidets usually require an amount of space that is not available in the typical bathroom. Separate plumbing facilities are costly.

The closest reference found by Applicant corresponds to U.S. Pat. No. 4,596,058 issued on June 24, 1986 to Nourbakhsh. This patent, however, fails to disclose any mounting means to the flanged section of a two-piece toilet or supporting means for the valves.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an accessory device that can be removably mounted to conventional two piece toilet pieces.

It is another object of this invention is to provide one of such accessories that can be readily used with existing toilets and requiring a minimum of space.

It is another object of this present invention to provide such an accessory that can be hygienically operated.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
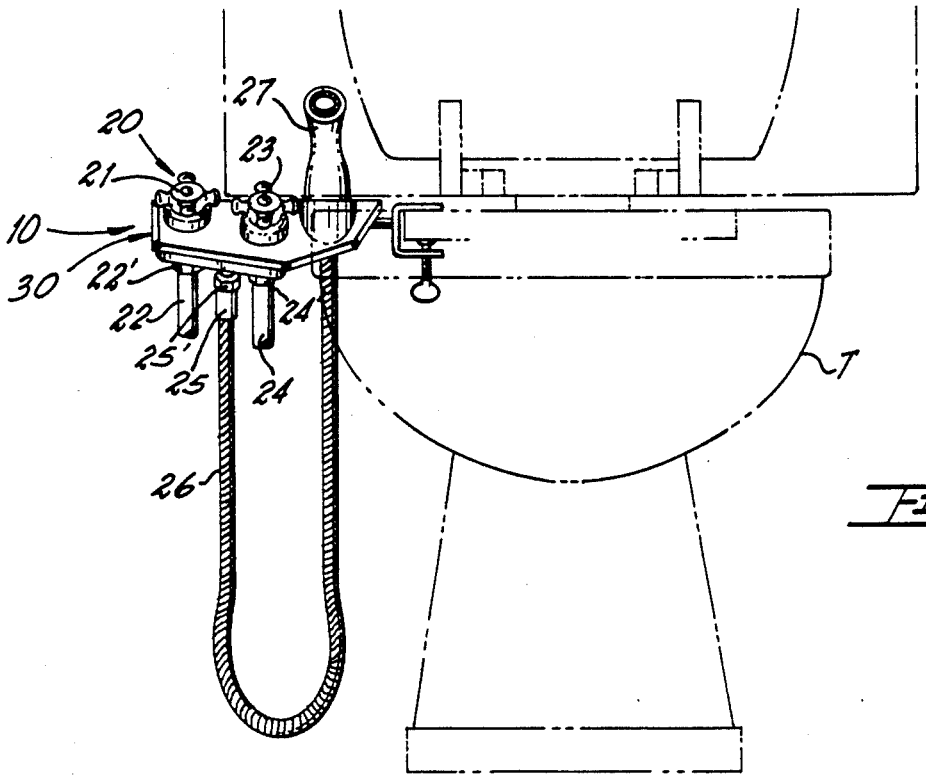
FIG. 1 shows the present invention installed in a two-piece toilet fixture.
Figure 2:
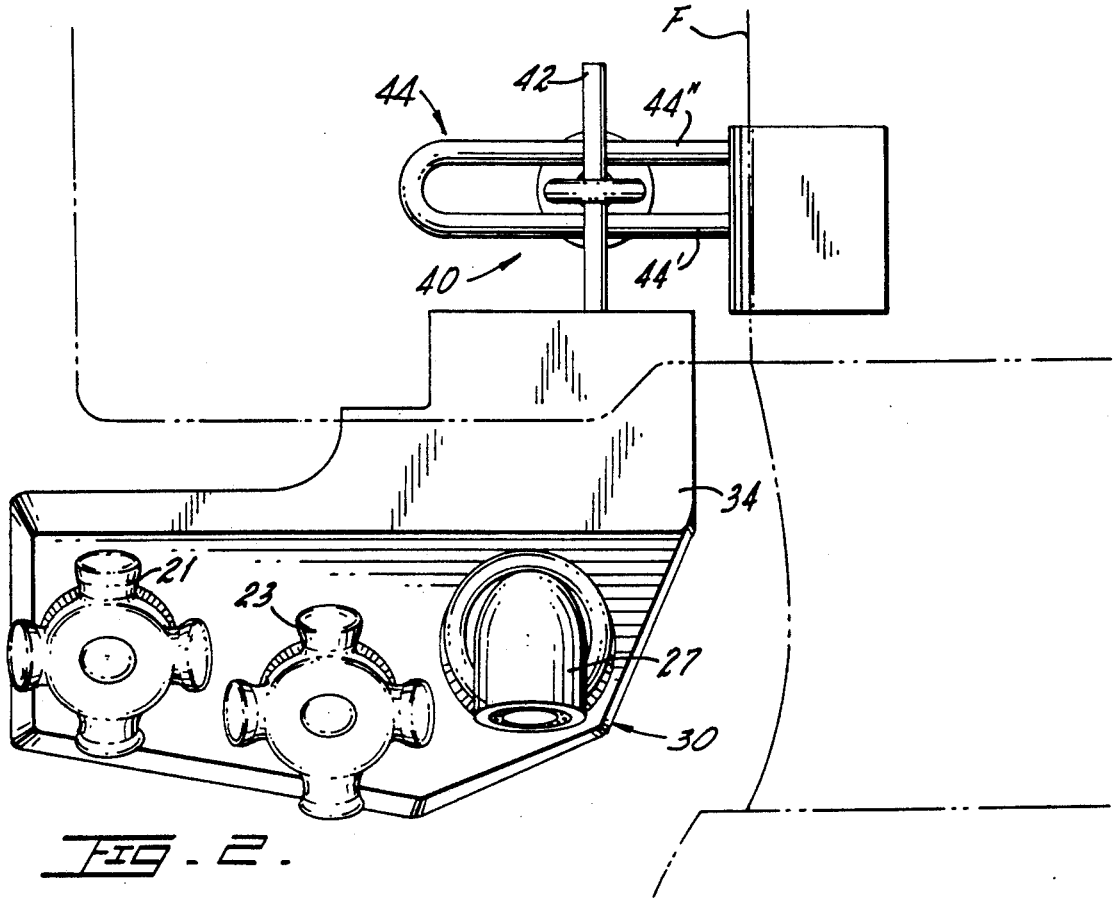
FIG. 2 represents a top view of the bidet accessory subject of the present invention.
Figure 3:
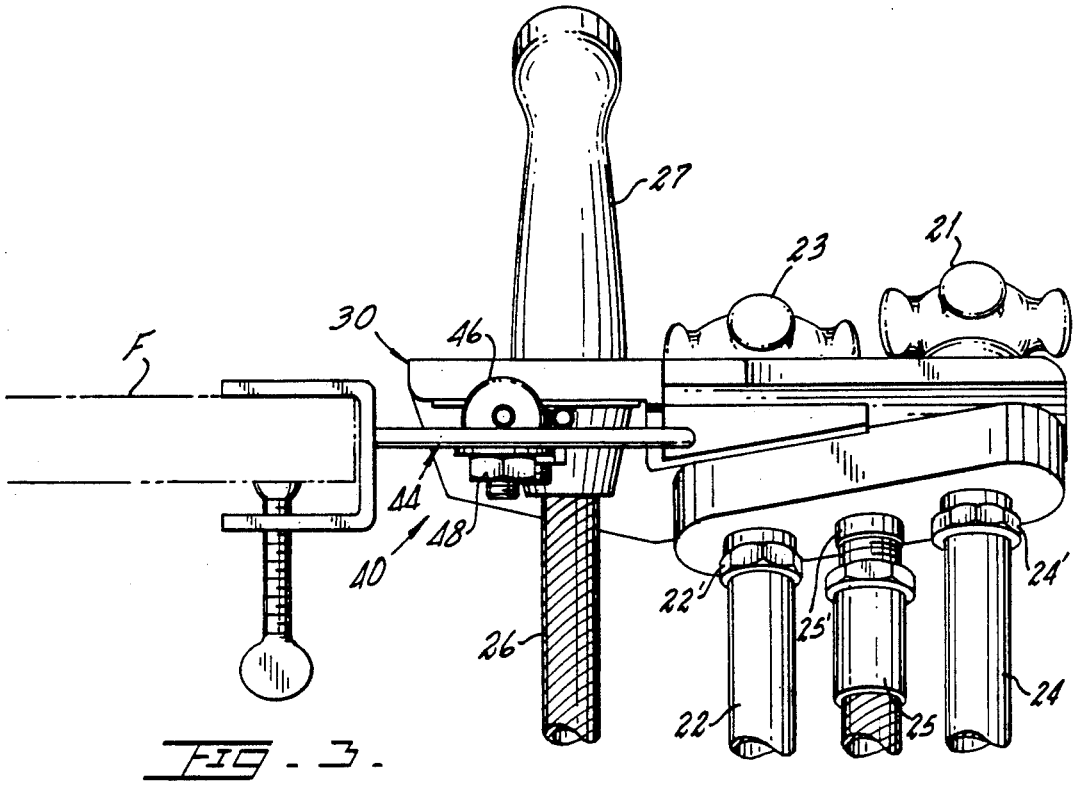
FIG. 3 illustrates a rear view of the invention.
Figure 4:
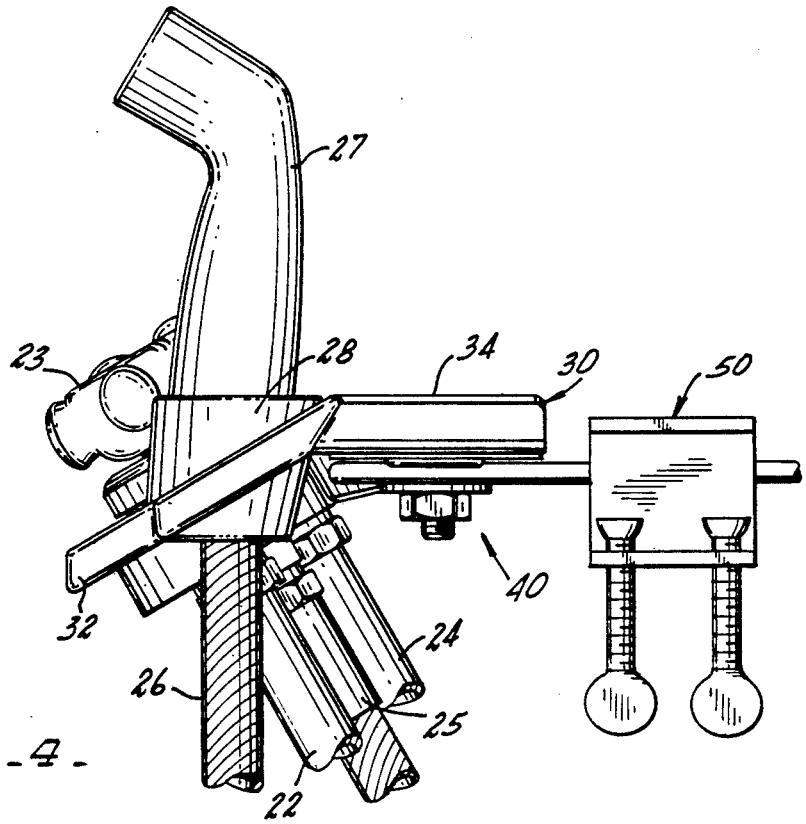
FIG. 4 is a side view of the bidet accessory.

Referring now to FIGS. 1 and 2, where the present invention is generally referred to with numeral 10, it can be observed that it basically includes a valve assembly 20, supporting assembly 30 and mounting assembly 40. Conventional two-piece toilets include a flanged section F positioned behind the bowl of toilet T, as shown in FIG. 2. Bidet accessory 20 mounts to flange section F and provides sufficient flexibility to turn in any one of a multitude of angles depending on the space constraints of the particular installation.

Valve assembly 20 includes hot and cold water supplies 22 and 24 that are mixed depending on the regulation of valve members 21 and 23 providing water thorugh outlet 25 at the desired temperature. Flexible conduit member 26 is connected to outlet 25 at one end and the other end is connected to sprayer member 27.

Support assembly 30 includes, preferably, two joined flat members 32 and 34 disposed at an angle with respect to each other. Member 32 is sufficiently large to allow for the mounting of valve members 21 and 23, tubular holder 28 for sprayer member 27 and the connectors 22'; 24' and 25' for water supplies and outlet 25. Member 34 is joined to member 32 and it has sufficient area to permit mounting assembly 40 to be rigidly attached to the underside of member 34.

Figure 5:
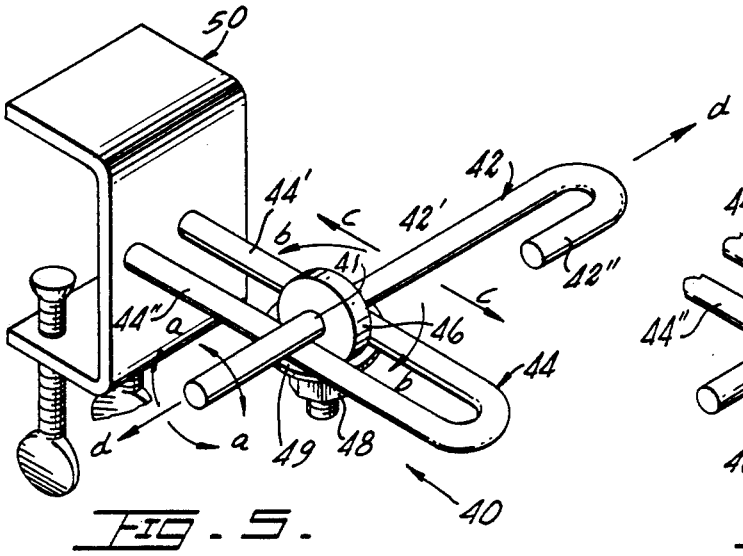
FIG. 5 shows a view, in perspective, of the mounting assembly, including the preferred embodiment of the crossed bars fastening mechanism.
Figure 8:
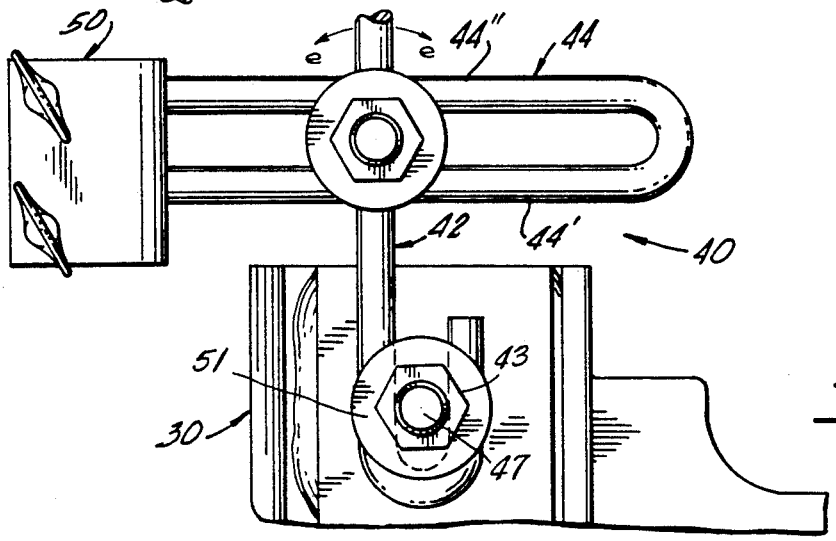
FIG. 8 shows a bottom view of the mounting assembly.

Mounting assembly 40 has the flexibility of adjusting any angle at which accessory 10 is to be installed, depending on the preferences of the user and the space constraints. As it can be seen from the figures, mounting assembly 40 includes a J-shape bar member 42 and a U-shape bar member 44 that cross each other and held in place by holding bolt member 46 and nut member 48. Bolt member 46 includes a head with a transversal opening 41 through which J-shape member is inserted. J-member 42 can be rotated with respect to supporting member 30 along line e—e, as shown in FIG. 8. Once the desired position is selected, J-member 42 can be kept in place by tightening bolt 47 and nut 43. Washer member 51 exerts a frictional force against member 42. As it can be observed in FIG. 5, a washer member 49 is used between nut member 48 and the underside of U-shape member 44 so that the separation of legs 44' and 44'' is smaller than washer member 49. There is a need for sufficient separation of legs 44' and 44'' to permit a certain amount of rotation in the plane defined by bar members 42 and 44 in the direction shown with letters b—b in FIG. 5. Bar member 42 can also move axially in the direction shown by the arrows referenced with the letters d—d or radially within the above mentioned plane defined by members 42 and 44. Finally, member 42 can also rotate around the axis of longer leg 42' as shown with letters a—a in FIG. 5. Also, member 42 can be slid along line c—c. With these possible movements, supporting assembly 30 can be installed in practically any position. It is held in place when nut member 48 is rotated urging J-shape bar member 42 against U-shape bar member 44 thereby frictionally engaging to each other and keeping each other secured in place. Bolt member 46 has an opening through which bar member 42 passed.

Figure 6:
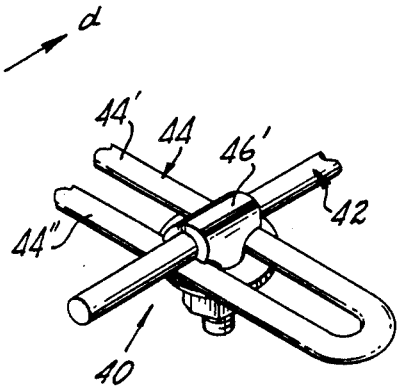
FIG. 6 is an alternate embodiment of the crossed bars fastening the mechanism.
Figure 7:
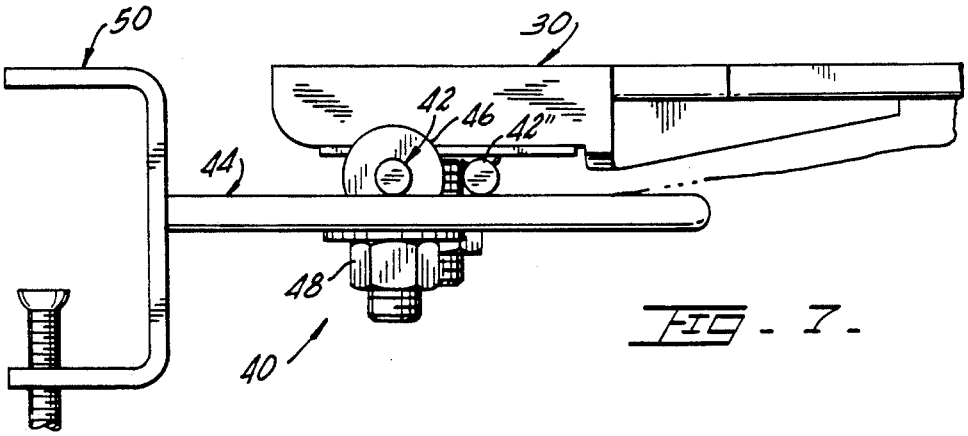
FIG. 7 illustrate an enlarged rear view of the mounting assembly.

An alternate embodiment is shown in FIG. 6 where bolt 46' has a concave head that engages member 42 urging the latter against member 44 in similar fashion. The ends of legs 44' and 44'' are rigidly mounted to clamp assembly 50 that cooperative engages with the flanged section F of the toilet T.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A bidet accessory for installation in two piece toilets, the toilets having flanged section in the rear and the bidet accessory being connected to hot and cold water supplies, the bidet accessory comprising:

A. supporting means;

B. valve means connected to said hot and cold water supplies for regulating the temperature of the water and further including an outlet through which said temperature regulated water flows and said valve means being mounted in said support means;

C. flexible conduit means having two ends and connected to said outlet at one of the ends;

D. sprayer means connected at the other end of said conduit means;

E. mounting means for rigidly mounting said supporting means to said flanged section of a toilet comprising a J-shape bar member having curved and long ends, said curved end being rigidly attached to said supporting means, a U-shape bar member having curved and legged ends, whereby said long end of said J-shape bar is perpendicularly and slidably attached by a first fastening means to said curved end of said U-shape bar member, said legged end of said U-shape bar member being rigidly attached to an attaching means, and said attaching means being removably attachable to said flanged section of a toilet, the mounting means being assembled so that said J-shape bar member cooperates with the U-shape bar member allowing the supporting means to be slidably adjustable with respect to the toilet.

2. The bidet accessory set forth in claim 1 wherein said attaching means to said flanged section further includes clamp means for cooperatively mounting to said flanged section and said clamp means are rigidly mounted to said legged end.

3. The bidet accessory set forth in claim 2 wherein said first fastening means includes a bolt member having a head with a transversal opening for cooperatively receiving said long end of said J-shape member and the body of said bolt member being inserted through the legs of said U-shape member, and a nut member for cooperatively engaging said bolt member and urging said U-shape member against said J-shape member.

4. The bidet accessory set forth in claim 3 wherein said supporting means includes second fastening means for securing said long end of said J-shape member in place thereby allowing angular adjustment between said long end and said supporting means.

5. The bidet accessory set forth in claim 2 wherein said first fastening means includes a bolt member with a head having a concave channel for receiving said J-shape member and a nut member for cooperatively engaging said bolt member and urging said U-shape member against said J-shape member.

* * * * *